US005279287A

United States Patent [19]

Wiseman, Sr.

[11] Patent Number: 5,279,287

[45] Date of Patent: Jan. 18, 1994

[54] COVERALLS FOR PROTECTION AGAINST FLASH FIRES

[75] Inventor: Timothy R. Wiseman, Sr., Richmond, Va.

[73] Assignee: E. I. du Pont de Nemours and Company, Wilmington, Del.

[21] Appl. No.: 873,177

[22] Filed: Apr. 24, 1992

Related U.S. Application Data

[63] Continuation of Ser. No. 612,906, Nov. 14, 1990, abandoned, which is a continuation-in-part of Ser. No. 459,368, Dec. 29, 1989, abandoned.

[51] Int. Cl.[5] ..... A62B 17/04; A62B 18/00; A62B 7/00; A62B 9/00

[52] U.S. Cl. ..... 128/201.29; 128/201.22; 128/205.22

[58] Field of Search ..... 128/201.22, 201.24, 128/201.29, 202.24, 205.22

[56] References Cited

U.S. PATENT DOCUMENTS

| | | | |
|---|---|---|---|
| 1,095,089 | 4/1914 | Dinn | 128/201.29 |
| 2,335,873 | 12/1943 | Morse, Sr. | 128/144 |
| 2,573,414 | 10/1951 | Dunn | 128/144 |
| 2,779,331 | 1/1957 | Trexler | 128/140 |
| 2,881,758 | 4/1959 | Motsinger | 128/144 |
| 3,049,896 | 8/1962 | Webb | 62/384 |
| 3,185,149 | 5/1965 | Rentsch, Jr. | 128/144 |
| 3,516,404 | 6/1970 | Spross | 128/142.5 |
| 4,250,876 | 2/1981 | Kranz | 128/202.22 |
| 4,455,687 | 6/1984 | Johansson | 2/424 |
| 4,513,452 | 4/1985 | Rankin, Sr. et al. | 2/81 |
| 4,750,443 | 6/1988 | Blaustein et al. | 112/420 |
| 4,864,654 | 9/1989 | Schriver et al. | 2/84 |

FOREIGN PATENT DOCUMENTS

| | | |
|---|---|---|
| 849461 | 11/1939 | France . |
| 284777 | 4/1931 | Italy . |
| 214290 | 1/1941 | Switzerland . |

OTHER PUBLICATIONS

Research Disclosure, Publication Item No. 29498, "Calculation of Fabric Tightness Factor", pp. 833-836 (Oct. 1988).

U.S. Statutory Invention Registration No. H805 (Schriver et al.) published Aug. 7, 1990 and filed Sep. 18, 1889.

"Fyrepel" Protective Wear Brochure dated 1984, Box 518, Newark, OH 43055, The First Total Flash Fire/-Chemical Protective System.

*Primary Examiner*—Edgar S. Burr
*Assistant Examiner*—K. L. Asher

[57] ABSTRACT

Coveralls for protecting a wearer from a flash fire comprising a source of breathing air adapted to be carried on the wearer's back, a respirator adapted to supply air at the wearer's face, and a conduit connecting the source of breathing air and the respirator. The coveralls include a one-piece main suit and a detachable head covering comprised of a heat-resistant fabric adhered to a layer of aluminum that forms the outer surface of the main suit and head covering. An insulating inner liner is contained within the one-piece main suit and head covering. The main suit has main suit sleeves and leg portions connected to a torso portion with a waist area. The detachable head covering includes a viewing lens and a downwardly-draping hood dimensioned to envelope the wearer's head and upper area of the torso portion of the main suit such that the source of breathing air and the conduit are protected in the event of a flash fire.

7 Claims, 5 Drawing Sheets

COVERALLS FOR PROTECTION AGAINST FLASH FIRES

This is a continuation of application Ser. No. 07/612,906, filed Nov. 14, 1990, now abandoned, which is in turn a continuation-in-part of application Ser. No. 07/459,368, filed Dec. 29, 1989 now abandoned.

FIELD OF THE INVENTION

The present invention relates to garments for providing protection to the wearer in a hazardous environment and more particularly relates to protective coveralls for the protection against flash fires.

BACKGROUND OF THE INVENTION

Flash fires are a potential hazard to industrial workers at some facilities due to leaks of flammable vapors such as a flammable heat transfer media, i.e., DOWTHERM ®, and from leaking flammable gases such as propane. If a high concentration of such vapors or gases build-up in a localized area and such vapors or gasses are ignited, a flash fire can result. While such fires typically have a short duration, i.e., three to five seconds, the intense heat from such fires can cause great injury to workers in the area of the fire such as those attempting to repair the source of the leak. In addition, the fires often consume available oxygen or produce harmful gases which impair or prevent breathing and hamper escape from the area.

Protective coveralls for protection against a wide variety of hazards such as corrosive liquids, hot liquids, molten metals and the like are known and are commercially available. However, such known garments generally cannot provide effective protection against flash fires. Other coveralls for use as fire entry garments are intended to protect against flame, radiant heat and contact heat. However, these suits typically would not be effective against flash fires since they are typically used together with an exposed breathing air supply which can be donned quickly in emergency situations. Thus, the air supply can be damaged due to its exposure in a flash fire, possibly cutting off the air supply.

SUMMARY OF THE INVENTION

In accordance with the invention, protective coveralls for protecting a wearer of the coveralls against a flash fire are provided The coveralls comprise a self-contained source of breathing air adapted to be carried on the wearer's back, a respirator adapted to supply air at the wearer's face, and a conduit connecting the source of breathing air and the respirator. The coveralls also comprise a one-piece main suit and a detachable head covering, both comprised of a heat-resistant fabric adhered to a layer of aluminum which forms their outer surface The one-piece main suit and the head covering both have an insulating inner liner. The one-piece main suit has main suit sleeves and leg portions connected to a torso portion with a waist area. The detachable head covering comprises a viewing lens and downwardly-draping hood with the downwardly-draping hood being dimensioned to extend downwardly and envelop the wearer's head and the upper area of the torso portion of the main suit. The hood therefore covers the wearer's head and face while wearing the respirator and covers the source of breathing air and the conduit while the said source is carried on the wearer's back. The hood terminates at a waist opening adjacent the waist area and has an adjuster for adjusting the size of the hood adjacent the waist opening to provide for snug contact of the hood with the one-piece main suit The hood also has hood sleeves which extend downwardly at least partially over the sleeves of the main suit to hood sleeve openings. Each of the hood sleeve openings have adjusters for adjusting the size of the sleeves adjacent the openings for snug contact of the hood sleeves with the main-suit sleeves.

In a preferred form of the present invention, the heat-resistant fabric of the main suit and head covering comprises a woven fabric of poly(paraphenylene terephthalamide) continuous filament yarns weighing at least 230 $g/m^2$ to which is adhered a layer of aluminum. Most preferably, the poly(paraphenylene terephthalamide) fabric has a fabric tightness of at least 0.85 and the total weight of the fabric and the aluminum layer is in the range of 300 to 400 $g/m^2$.

In another preferred form of the present invention, the insulating inner liner comprises a multilayer liner comprising at least an inner layer of woven aramid fabric and a layer of nonwoven aramid fabric.

In accordance with another aspect of the present invention, the protective coveralls further comprises an inner hood of heat-resistant fabric to be worn inside the head covering and which covers the respirator and the head and neck of the wearer in use. The inner hood has a tubular extension for admitting the conduit into the inner hood and covering the conduit. Preferably, the heat resistant fabric of the inner hood comprises a knit aramid fabric.

The coveralls of the invention are capable of protecting the air source, respirator and conduit in the event of a flash fire, thereby reducing the risk to the wearer of losing his air supply. In addition, the preferred coveralls in accordance with the invention provide protection against high pressure jets of steam.

BRIEF DESCRIPTION OF THE DRAWINGS

The invention and its advantages may be understood by reference to the following detailed description when read in conjunction with the accompanying drawings in which.

DETAILED DESCRIPTION OF THE PREFERRED EMBODIMENTS

Figure 1:
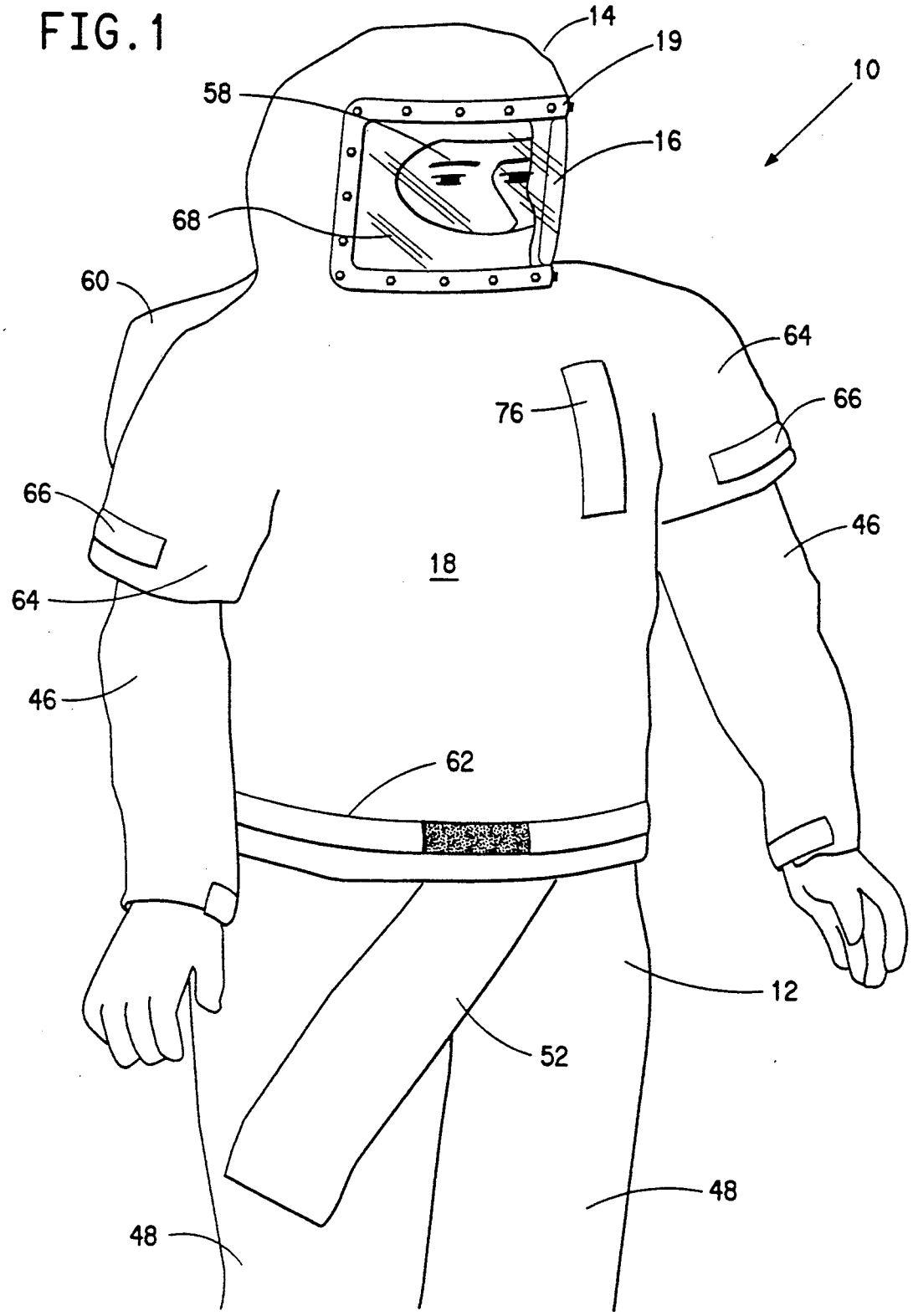
FIG. 1 is a somewhat diagrammatical perspective view of a preferred embodiment of coveralls in accordance with the present invention.

Referring now to the drawings in which like reference characters designate like or corresponding parts throughout the several views, protective coveralls 10 are shown in FIG. 1 which embody a preferred form of the present invention. The protective coveralls 10 include a main suit 12 and a removable head covering 14. The head covering 14 has a viewing lens 16 and a downwardly draping hood 18 dimensioned to extend downwardly and envelop the wearer's head and the upper area of the main suit 12 in use as will be explained in more detail hereinafter.

Figure 2:
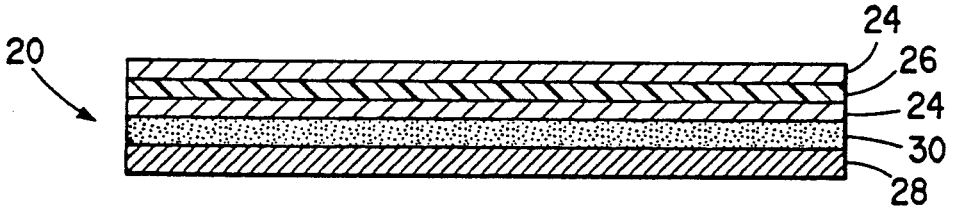
FIG. 2 is a schematic representation in cross-section of a preferred arrangement of the layers of the outer shell of the coveralls.
Figure 3:
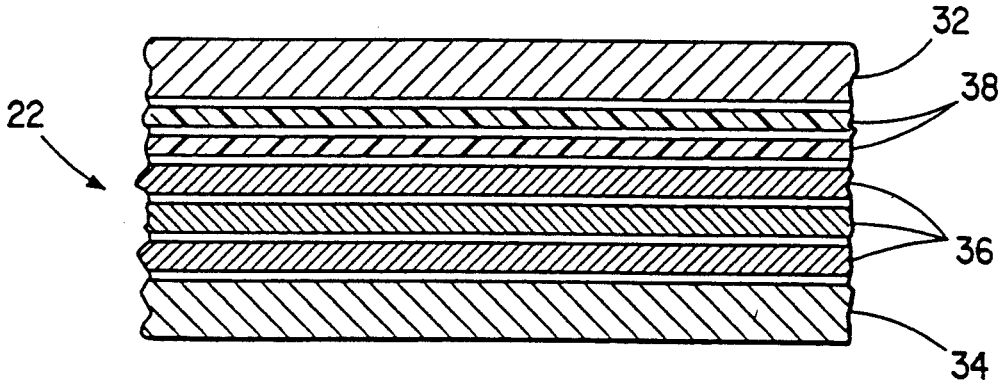
FIG. 3 is a schematic representation in cross-section of a preferred arrangement of the layers of the inner liner of the coveralls.

The coveralls 10 depicted are intended to represent coveralls which have laminated construction capable of protecting the wearer against flash fires. In accordance with the present invention and as illustrated in FIGS. 2 and 3, the protective coveralls have an outer shell 20 and an inner liner 22. The outer shell 20 comprises a heat-resistant fabric adhered to a layer of aluminum which forms the outer surface of the the main suit 12 and head covering 14. As will be explained in more detail hereinafter, the outer shell 20 of the main suit 12 and head covering 14 is constructed in a manner that decreases the risk of flash fire entering the interior of the coveralls 10 and injuring the wearer. The outer shell 20 works in cooperation with the inner liner 22 and can be attached or separated from the outer shell 20. The inner liner 22 provides thermal insulation between the heat-resistant outer shell and the skin of the coverall's wearer.

Figure 5:
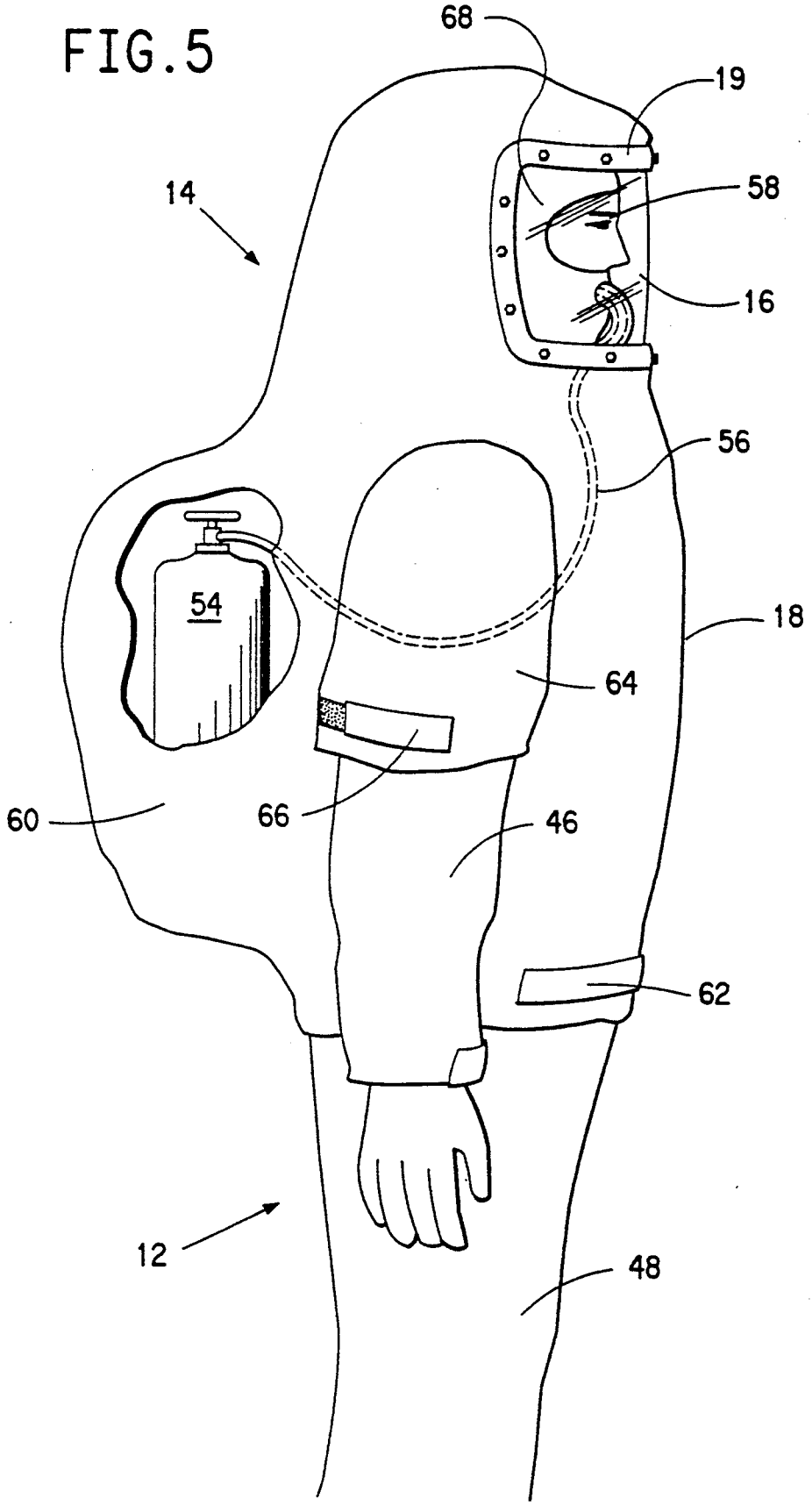
FIG. 5 is a partially broken-away side elevational view of the coveralls of FIG. 1.

Referring to FIGS. 1 and 5, the viewing lens 16 of the head covering 14 is constructed using a metal frame 19 which frames an opening in the front of the hood 18 at a location corresponding to the upper face area of the wearer. The metal frame 19 supports and is used to connect the permanent lens 16 to the hood 18. The permanent viewing lens 16 can be a shatter resistant transparent polymeric material which is flexible and thus conforms to the shape of the frame 19. A preferred material for this purpose is the polycarbonate sheet having a thickness of 0.4 cm (0.156 inches) sold by General Electric under the trademark LEXAN ®. The lens 16 in the protective coveralls depicted is supported by the metal frame 19 in a generally cylindrical configuration as is apparent from FIG. 5. Preferably, the cylindrical viewing lens 16 provides an arc of the cylinder at least 165°, most preferably 180°, to give the wearer a field of view which is near normal in terms of width.

In the preferred embodiment depicted in FIG. 2, the heat-resistant outer shell 20 comprises two layers of aluminum 24 adhered to each other by film 26, which is preferably of a polyethylene terephthalate/isophthalate copolymer The interior of the two aluminum layers is adhered to the heat-resistant fabric layer 28, preferably by means of a neoprene-based adhesive 30. The outer aluminum layer 24 forms the outermost surface of the coveralls. Preferably, the heat-resistant outer shell 20 with the aluminum layers has a total weight in the range of 300 to 400 g/m$^2$.

The heat resistant fabric layer 28 of the outer shell preferably is woven using continuous filament yarns of poly(p-phenylene terephthalamide) (referred to herein as "PPD-T") weighing at least about 230 g/m$^2$. Generally, heavy dtex aramid yarns, usually at least 800 dtex and preferably at least 1,000 dtex, are woven into a plain or twill weave fabric in which the yarns of the woven fabric are tightly jammed together. Generally, the fabric of the outer shell has a "fabric tightness" of at least 0.85, preferably, at least 0.95, and most preferably, at least 0.99. "Fabric tightness" for the purposes of this application is determined and calculated as described in Research Disclosure, October, 1988, Publication Item No. 29498, "Calculation of Fabric Tightness Factor", pp. 833–6. In determining the fabric tightness, the decitex of a yarn is determined by removing the yarn from the fabric, hand extending the yarn to obtain a length of yarn without weave crimp, and then weighing that length to determine its approximate dtex. Then the yarn is loaded to 0.11 g/dtex and the length is remeasured. The remeasured length is used together with the weight of that length of yarn to calculate the dtex used in the formula for fabric tightness.

A preferred inner liner for the main suit 12 and head covering 14 is a multilayer laminate comprising at least a layer of woven aramid fabric and a nonwoven aramid fabric layer.

The insulating inner liner 22 of the coveralls of the invention depicted in FIG. 3 comprises outer and inner woven poly(metaphenylene isophthalamide) fabrics 32 and 34, respectively, and multiple fibrous nonwoven layers of poly(paraphenylene terephthalamide) 36, and a pair of thin film layers 38, all fastened together, preferably by quilting stitches (not shown in the drawings). Preferably, at least two film layers 38 are used, although it will be understood that a single film layer can also be used to provide adequate protection. The multiple fibrous nonwoven layers of poly(paraphenylene terephthalamide) 36 in the inner liner number at least three and have a total weight of from about 150 to about 400 g/m$^2$. Preferably, each fibrous nonwoven layer 36 comprises a nonaperatured spunlaced fabric of aramid staple fibers.

The woven inner and outer poly(metaphenylene isophthalamide) fabrics 32 and 31, respectively, of liner 22 preferably are formed of yarns of poly(m-phenylene isophthalamide) staple fibers. The inner and outer woven fabrics of the inner liner protect the thermal insulating liner from damage during use and during laundering or cleaning.

The film layers 38 of the inner liner 22 are preferably two thin films comprised of a synthetic polymer. Preferably, the films 38 are adjacent to each other and positioned between outer woven fabric 32 and the outermost fibrous nonwoven layer 36. Preferably, films 38 are composed of a terephthalate copolyetherester that is breathable (i.e., they permit the slow passage of vapor) but impermeable to liquid water.

The total of weight of all of the layers of the inner liner is typically in the range of about 300 to about 750 g/m$^2$, preferably from about 350 to about 500 g/m$^2$, in order to keep the coveralls lightweight.

The outer shell and inner liner construction provides a barrier and thermal protection and decreases the risk of injury to the wearer in the event of a flash fire. In addition, the preferred coveralls of the invention provide the wearer with protection against high pressure jets of steam For example, the outer fabric is not destroyed by jets of steam of 2670 to 6030 kPa (400 to 875 psi). Also, the coveralls provide the wearer with additional seconds to escape from the steam jet and avoid getting burned. The coverall gives the wearer at least 5 seconds to escape from a jet of saturated steam of 2760 kPa, before such a jet can raise the temperature of the innermost surface of the coverall sufficiently for the wearer to first perceive pain and about another 5 seconds before the wearer would receive a second degree burn.

Figure 4:
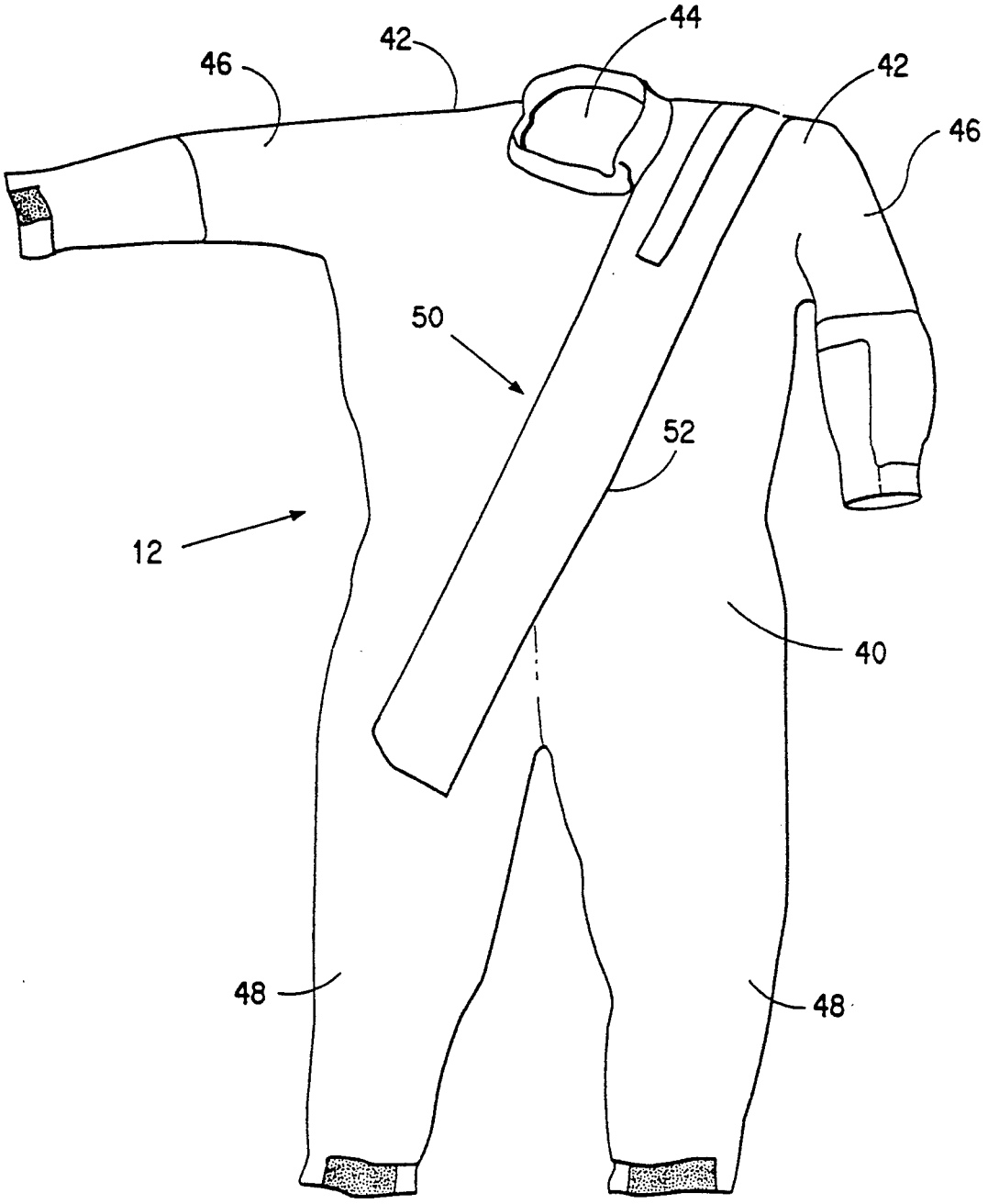
FIG. 4 is an elevational front view of a main suit forming a portion of the coveralls illustrated in FIG. 1.

Referring to FIG. 4, the main suit 12 of the coveralls includes a torso portion 40 including shoulder areas 42 and neck opening 44. Sleeve and leg portions, 46 and 48, respectively, are connected to the one-piece main suit 12.

Referring still to FIG. 4, a main closure 50 is provided in the main suit 12 for providing access into the suit. The main closure 50 includes a slit-like zippered opening (not shown) which, in the suit depicted, extends downwardly from the neck opening 44 adjacent the uppermost area of one shoulder area 42 and which extends diagonally across the front of the torso portion 40 to a position adjacent an upper area of the opposite leg portion 48. The opening of the closure is covered by an elongate flap 52. The elongate flap 52 is attached to the main suit 12 along and adjacent to one side of the opening but is removable from the opposite side of the zipper since it is secured by means of complementary hook and loop fastening tapes (not shown), such as those sold under the trademark VELCRO ®.

Figure 6:
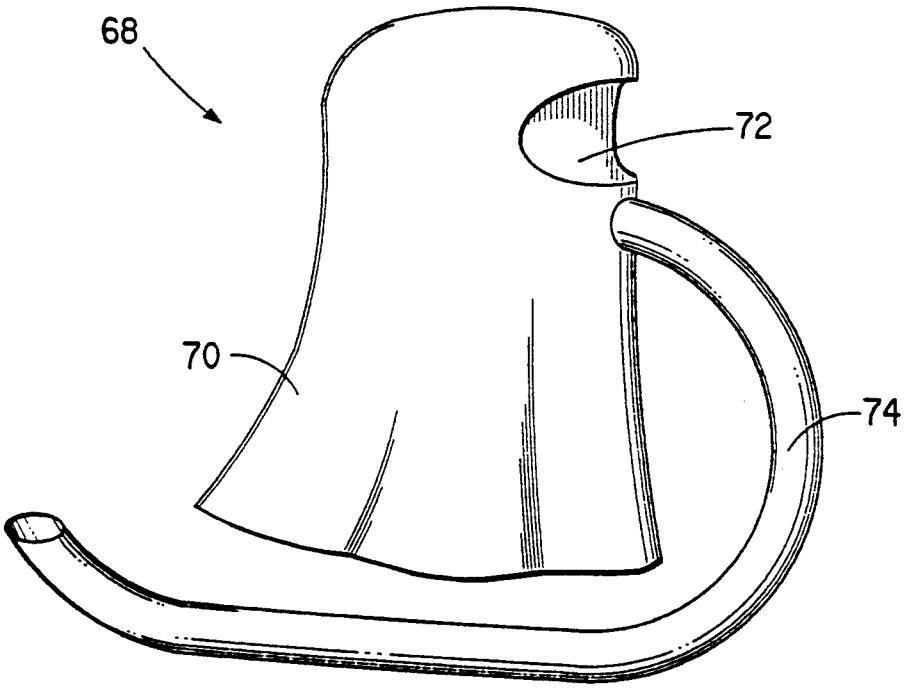
FIG. 6 is a perspective view of an inner hood used with a preferred form of the coveralls of the invention.

Referring now to FIGS. 1, 5 and 6, the coveralls 10 include a source of breathing air 54. The air source preferably is a permissible one-half hour self-contained pressure demand type compressed air breathing apparatus such as that sold by Scott Aviation, a division of A-T-O Inc., Lancaster, New York, under the trademark SCOTT AIR-PACK ®. Air sources of this type are provided with a backpack-type frame and straps and should be worn on the wearer's back outside of the main suit 12. The air source includes a conduit such as air hose 56 which extends from the air source to the face of the wearer Breathing apparatus of this type include a full face respirator (the viewing lens of which is identified by reference character 58), which is worn by the wearer inside of the head covering 14.

The hood 18 of the head covering 14 is provided with an air source receptacle area 60 which is appropriately dimensioned so that the hood 18 completely covers the air source 54. The hose 56 between the air source 54 and the respirator extends underneath the arm of the wearer and thus is also covered by the hood 18.

As is shown in FIGS. 1 and 5, the hood 18 terminates at a waist opening at the waist area of the main suit 12 and is provided with adjustment straps 62 secured by fasteners such as the hook and loop fastening tapes sold under the trademark VELCRO ®. The adjustment straps 62 enable the adjustment of the size of the waist opening to insure a snug fit between the lower area of the hood 18 and the outer surface of the main suit 12. In addition, the hood 18 is provided with short hood sleeves 64 which extend partially down the sleeves 46 of the main suit 12. The hood sleeves 64 are provided with adjustment straps 66 with fasteners such as hook and loop fastening tapes sold under the trademark VELCRO ® which are used to adjust the size of the sleeve openings in the sleeves 64 to provide a snug fit between the hood sleeves 64 and the exterior of the sleeves 46 of the main suit 12.

For use in adjusting air supply controls on the respirator in the event of a malfunction, there is provided an access opening 76 in the front of the hood 18. The opening is closed by fasteners such as hook and loop fastening tapes such as those sold under the trademark VELCRO ® and enables a hand to be inserted into the opening.

Referring now to FIG. 6, the preferred coveralls include an inner hood 68 of a heat-resistant fabric. The inner hood is provided with a hood skirt 70 which extends below the head of the wearer and an opening 72 to register with the viewing lens 58 of the respirator The inner hood is also preferably provided with a tubular extension 74 which extends from the lower face area and has a length sufficiently long that it covers the hose 56 back to the air source 54. A preferred fabric for fabrication of the inner hood 68 comprises a knit aramid fabric such as knit poly(metaphenylene isophthalamide).

In use, the main suit 12 of the depicted protective coveralls 10 in accordance with the invention are donned by a wearer by opening the closure 50 of the main suit 12 and entering the main suit. The opening in the main suit 12 is closed by the zipper and the elongate flap 52 is used to cover the zipper.

Once the wearer is in the main suit, the wearer then puts on the air supply 54 and respirator. The inner hood 68 is placed over the wearer's head and the hose 56 is fed through the tubular hose covering 74 and connected to the respirator in place on the wearer's face. The inner hood 68 is positioned so that the opening 72 in the inner hood is appropriately aligned with the viewing lens 58 of the respirator. Usually with the assistance of another person, the head covering 14 is then placed over the wearer's head and the wearer's arms are slipped into the hood sleeve 64 and the hood is then pulled downwardly around the torso area and down to the waist. The adjustment straps 62 at the waist opening are appropriately adjusted using the hook and loop fastening tapes to ensure a snug fit around the wearer's waist. Similarly, the adjustment straps 66 on the hood sleeve 64 are adjusted to provide a secure fit about the sleeves 46 of the main suit 12.

The coveralls 10 in accordance with the invention provide protection to the wearer in the event of a flash fire. The construction of the suit provide barrier and thermal protection which can prevent injury provided that the duration of the fire is rather short as is typical for flash fires. In the preferred suit employing poly(-paraphenylene terephthalamide) outer shell fabrics which have a "fabric tightness" of at least 0.85 and a total outer shell weight of from about 300 to about 400 $g/m^2$, protection against penetration by high pressure steam jets (2670–6030 kPa–400–875 psi) is also provided In addition, the air source, air hose and respirator are fully enclosed within the hood 18 having both the outer shell and inner liner and thus are protected from a flash fire so that the wearer has a better opportunity to escape from the area in the event that available oxygen is consumed or harmful gases are produced by the fire In the most preferred form of the coveralls employing the inner hood 68, further protection is provided to the wearer's head, the respirator, and the air hose 56 which further assist in decreasing the risk of injury to the wearer.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. Protective coveralls for providing protection to a wearer of the coveralls against direct contact with a flash fire wherein intense heat and harmful gases are produced in a short period of time, comprising:

a self-contained source of breathing air adapted to be carried on the wearer's back;

a respirator adapted to supply air at the wearer's face; conduit means connecting said source of breathing air and said respirator; and a one-piece main suit and a detachable head covering comprised of a heat-resistant fabric adhered to a layer of aluminum which forms the outer surface of the said main suit and said head covering, said one-piece main suit and said head covering having an insulating inner liner; said one-piece main suit having a main suit sleeves and leg portions connected to a torso portion with a waist area; said detachable head covering including a viewing lens and downwardly-draping hood, said downwardly-draping hood being dimensioned to extend downwardly and envelop the wearer's head and the upper area of the torso portion of the main suit so that said hood completely covers the wearer's head and face while wearing said respirator, said hood further completely covering said source of breathing air and said conduit means while said air source is carried on the wearer's back, said hood terminating at a waist opening at said waist area and having means for adjusting the size of said hood adjacent said waist opening to provide for snug contact of said hood with said one-piece main suit adjacent said waist opening, said hood further including hood sleeves which extend downwardly at least partially over the sleeves of said main suit to hood sleeve openings, each of said hood sleeve openings having means for adjusting the size of said sleeves adjacent said openings for snug contact of said hood sleeves with said main-suit sleeves;

said coveralls providing a barrier that decreases the risk of the flash fire entering the interior of said coveralls and damaging said source of breathing air, said respirator or said conduit means, or injuring the wearer when direct contact with the flash fire occurs.

2. The protective coveralls of claim 1 wherein said heat-resistant fabric of said main suit and said head covering comprises a woven fabric of poly(paraphenylene terephthalamide) continuous filament yarns weighing at least 230 g/m$^2$, the fabric being adhered to said layer of aluminum.

3. The protective coveralls of claim 2 wherein said poly(paraphenylene terephthalamide) fabric has a fabric tightness of at least 0.85 and said fabric with said adhered aluminum layer has a total weight in the range of 300 to 400 g/m$^2$.

4. The protective coveralls of claim 1 wherein said insulating inner liner comprises a multilayer liner comprising at least an inner layer of woven aramid fabric and a layer of nonwoven aramid fabric

5. The protective coveralls of claim 1 wherein said respirator comprises a respirator with a respirator viewing lens for substantially covering the face of the wearer and said conduit means connecting said source of breathing air to said respirator comprises a rubber hose.

6. The protective coveralls of claim 5 further comprising an inner hood of heat-resistant fabric to be worn inside said head covering and which covers said respirator and the head and neck of the wearer in use, said inner hood comprising an opening for exposing said respirator viewing lens and comprising a tubular extension for admitting said hose into said inner hood and covering said rubber hose of said respirator.

7. The protective coveralls of claim 6 wherein said heat resistant fabric of said inner hood comprises a knit aramid fabric

* * * * *